US011110726B2

(12) United States Patent
Yamada et al.

(10) Patent No.: US 11,110,726 B2
(45) Date of Patent: Sep. 7, 2021

(54) CUTTER DEVICE AND PRINTING APPARATUS

(71) Applicant: SEIKO EPSON CORPORATION, Tokyo (JP)

(72) Inventors: Koji Yamada, Okaya (JP); Hiroaki Sakajo, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/920,973

(22) Filed: Jul. 6, 2020

(65) Prior Publication Data

US 2021/0008903 A1 Jan. 14, 2021

(30) Foreign Application Priority Data

Jul. 9, 2019 (JP) ..... JP2019-127468

(51) Int. Cl.
*B41J 11/70* (2006.01)
*B26D 1/18* (2006.01)
*B26D 1/20* (2006.01)

(52) U.S. Cl.
CPC ..... *B41J 11/70* (2013.01); *B26D 1/185* (2013.01); *B26D 1/20* (2013.01)

(58) Field of Classification Search
CPC ..... B41J 11/70; B41J 11/706; B26D 1/185; B26D 5/00
See application file for complete search history.

(56) References Cited

U.S. PATENT DOCUMENTS 10,494,131 B2 * 12/2019 Mistyurik ..... B31D 1/026
2011/0280644 A1 * 11/2011 Toyoshima ..... B26D 1/205 400/621

FOREIGN PATENT DOCUMENTS

JP 2011-235428 A 11/2011

* cited by examiner

*Primary Examiner* — Huan H Tran
(74) *Attorney, Agent, or Firm* — Workman Nydegger

(57) ABSTRACT

A cutter device includes a pair of pulleys including a first pulley and a second pulley, an endless belt spanning the pair of pulleys, a holder that holds a movable blade and moves in accordance with a movement of the endless belt, a first sensor configured to detect that a position of the movable blade is at a first position, and a second sensor configured to detect that the position of the movable blade is at a second position. The first sensor and the second sensor are disposed at positions overlapping with the holder in an up-down direction. The holder includes a first arm protruding toward the first position and a second arm protruding toward the second position. The first arm faces the first sensor when the holder is at the first position, and the second arm faces the second sensor when the holder is at the second position.

5 Claims, 4 Drawing Sheets

CUTTER DEVICE AND PRINTING APPARATUS

The present application is based on, and claims priority from JP Application Serial Number 2019-127468, filed Jul. 9, 2019, the disclosure of which is hereby incorporated by reference herein in its entirety.

BACKGROUND

1. Technical Field

The disclosure relates to a cutter device and a printing apparatus.

2. Related Art

In related art, a cutter device is known that is built into a printing apparatus and the like, and that cuts a printed continuous sheet. JP-A-2011-235428 discloses a cutter device using a round blade as a movable blade.

However, in the cutter device described in JP-A-2011-235428, a sensor for detecting a position of the movable blade is disposed above a holder on which the movable blade is mounted. Further, a plate for causing the sensor to detect the position of the movable blade is disposed above the holder. As a result, there is a problem in that the size of the cutter device increases in the up-down direction. Further, it has been difficult to reduce the size of an apparatus, such as a printing apparatus, that includes the cutter device.

SUMMARY

A cutter device includes a pair of pulleys including a first pulley and a second pulley, an endless belt spanning the pair of pulleys, a movable blade, a holder configured to hold the movable blade, engage with the endless belt, and move in a movement direction in accordance with a movement of the endless belt, a first sensor configured to detect that a position of the movable blade is at a first position on the first pulley side, and a second sensor configured to detect that the position of the movable blade is at a second position on the second pulley side. The first sensor and the second sensor are disposed at positions overlapping with the holder in an up-down direction intersecting the movement direction. The holder includes a first arm protruding from a holder main body toward the first position and a second arm protruding from the holder main body toward the second position. The first arm is positioned at a position facing a detection portion of the first sensor when the holder is positioned at the first position, and the second arm is positioned at a position facing a detection portion of the second sensor when the holder is positioned at the second position.

In the cutter device described above, the first sensor is preferably positioned on the second pulley side of the first pulley in the movement direction, and the second sensor is preferably positioned on the first pulley side of the second pulley in the movement direction.

The cutter device described above preferably includes a guide portion configured to engage with the holder and guide movement of the holder when the holder moves in the movement direction, and the first sensor and the second sensor are preferably positioned between the guide portion and the pair of pulleys in the up-down direction.

In the cutter device described above, in the movement direction, the first sensor is preferably positioned further to the outside than an end portion of the guide portion on the first position side, and the second sensor is preferably positioned further to the outside than an end portion of the guide portion on the second position side.

A printing apparatus includes the cutter device described above.

DESCRIPTION OF EXEMPLARY EMBODIMENTS

1. First Embodiment

Figure 1:
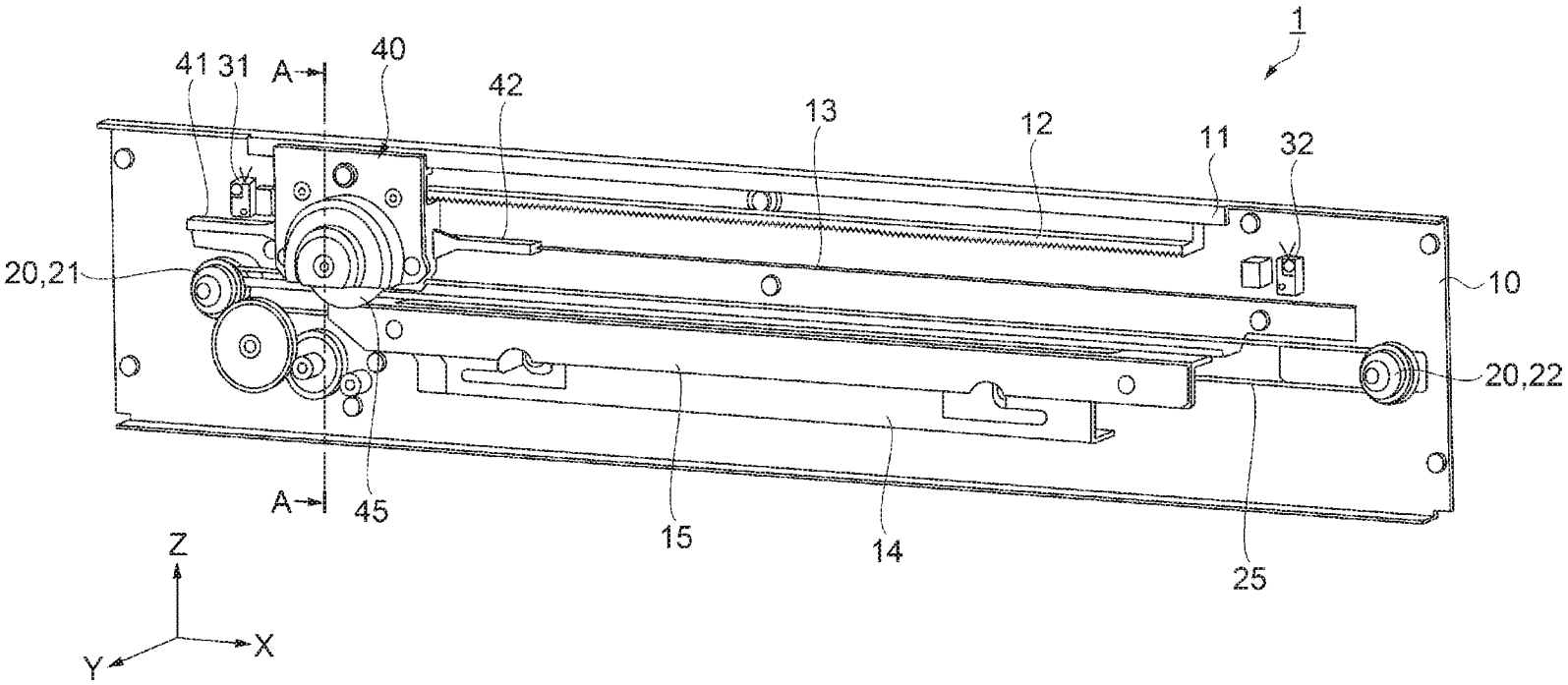
FIG. 1 is a perspective view illustrating a configuration of a cutter device according to a first embodiment.
Figure 2:
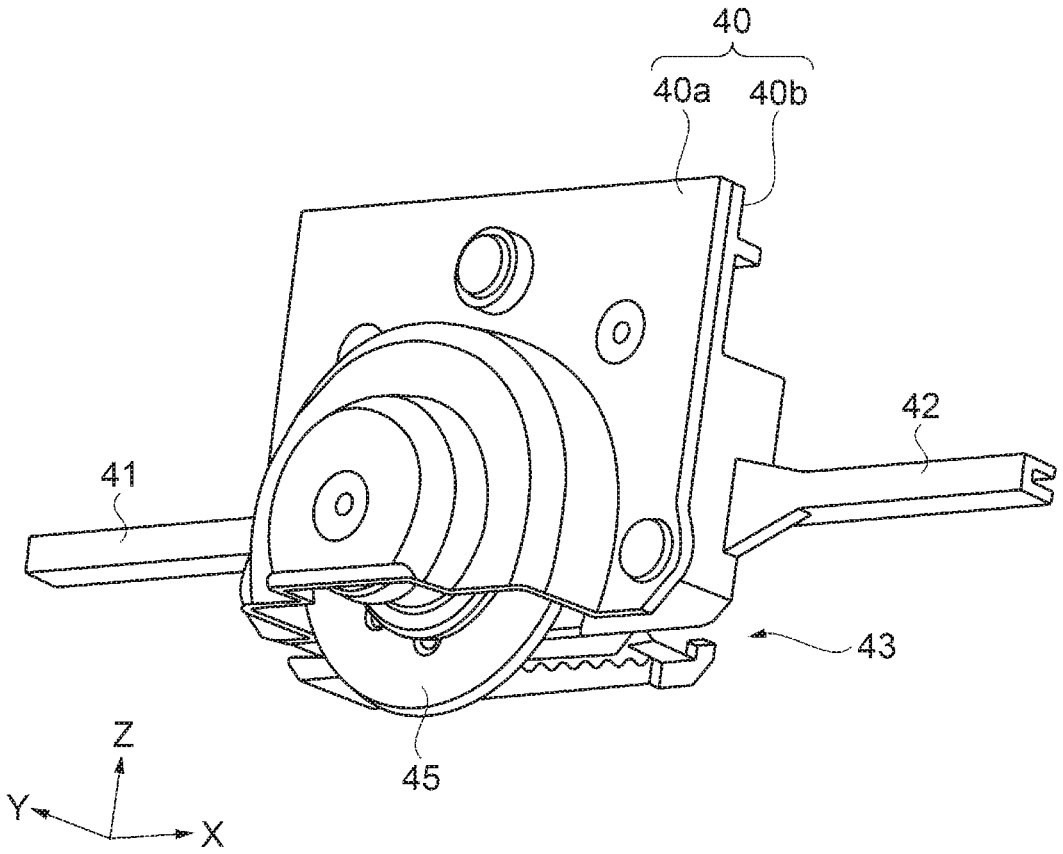
FIG. 2 is an enlarged perspective view illustrating a configuration of a holder.
Figure 3:
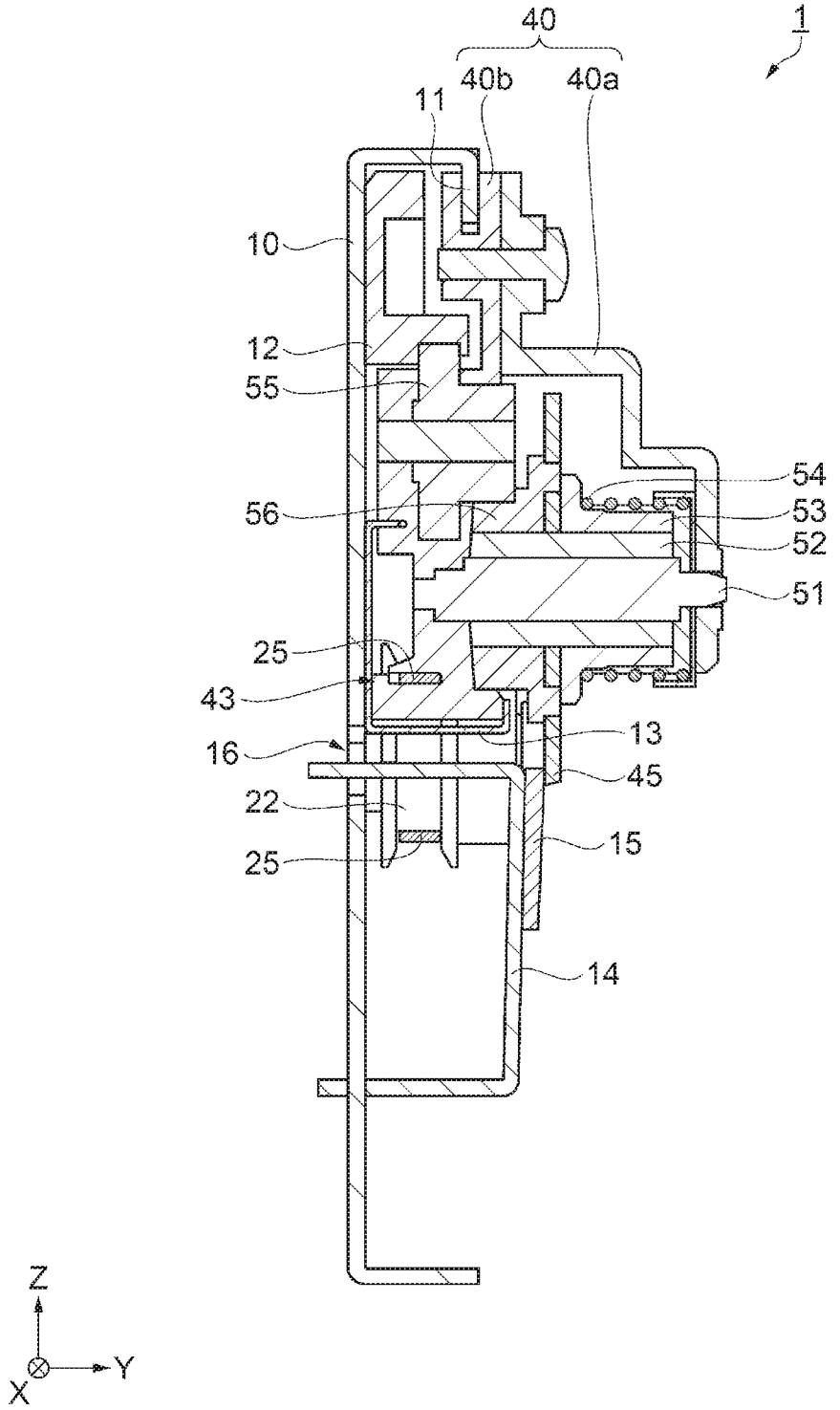
FIG. 3 is a cross-sectional view taken along a line A-A in FIG. 1.

FIG. 1 is a perspective view illustrating a configuration of a cutter device according to a first embodiment. FIG. 2 is a perspective view illustrating a configuration of a holder. FIG. 3 is a cross-sectional view taken along a line A-A in FIG. 1. First, a configuration of a cutter device 1 will be described. Note that, in coordinates indicated in the drawings, both directions along a Z axis are up-down directions and an arrow direction is "up", both directions along an X axis are left-right directions and an arrow direction is "right", and both directions along a Y axis are front-rear directions and an arrow direction is "front". In addition, a movement direction of a movable blade 45 corresponds to both the left and right directions.

As illustrated in FIG. 1 and FIG. 3, the cutter device 1 includes a frame 10 in which each of portions of the cutter device 1 is configured. The frame 10 has a rectangular shape that is long in the left-right direction, in a plane that includes the X axis and the Z axis. A pair of pulleys 20 is provided in the left-right direction, substantially in the center along the up-down direction of the frame 10. The pair of pulleys 20 includes a first pulley 21 and a second pulley 22. The first pulley 21 is provided at a position near the left end of the frame 10, and the second pulley 22 is provided at a position near the right end of the frame 10. An endless belt 25, one end of which is coupled to the other end of thereof, spans the pair of pulleys 20.

Power to rotate the first pulley 21 is supplied to the first pulley 21 from a motor via a plurality of gears. The endless belt 25 moves in the left and right directions as a result of the rotation of the first pulley 21. A section of the endless belt 25 that spans above the pair of pulleys 20 is engaged with a holder 40 that holds the circular movable blade 45. The holder 40 moves in the left and right directions in accordance with the movement of the endless belt 25.

The frame 10 includes a fixed blade support portion 14 that supports a fixed blade 15. The fixed blade support portion 14 is coupled to the frame 10 and protrudes to the front from the frame 10. With the frame 10, the fixed blade support portion 14 forms a hollow quadrangular pillar shape that is long in the left-right direction, and straddles a section of the endless belt 25 that spans below the pair of pulleys 20. The fixed blade 15 has a plate shape that is long in the left-right direction and is fixed to the front surface of the fixed blade support portion 14. The fixed blade 15 has a cutting edge on the upper side thereof.

The frame 10 includes a subframe 13. The subframe 13 is long in the left-right direction and is L-shaped in a side view from the left. The L-shaped side surface of the subframe 13 is coupled to the frame 10. The bottom side of the L shape of the subframe 13 protrudes from the frame 10 so as to face the upper surface of the fixed blade support portion 14, and supports the bottom surface of the holder 40. A paper feed port 16, which is communicated with a gap between the fixed blade support portion 14 and the subframe 13, is provided in the frame 10. For example, a recording medium S printed using the printing apparatus enters the interior of the cutter device 1 from the paper feed port 16, and is transported along the gap between the fixed blade support portion 14 and the subframe 13 onto the fixed blade 15.

The frame 10 includes a guide portion 11 that is engaged with the holder 40 and guides the movement of the holder 40 when the holder 40 moves in the left-right direction. The guide portion 11 is substantially the same length as the fixed blade 15, which is a range of movement of the holder 40 in the left-right direction, and has an inverted L-shape in a side view from the left. The guide portion 11 is a plate-like rail that protrudes to the front from the upper end of the frame 10 and then further bends downward.

The frame 10 includes a rack 12 provided with a plurality of teeth on a long bar-shaped flat plate that is long in the left-right direction. The rack 12 is provided in parallel to and below the guide portion 11, with the teeth facing downward. The rack 12 is coupled to the movable blade 45 via a plurality of gears. A linear motion that moves the holder 40 in the left-right direction is converted to a rotational force by the gears engaged with the rack 12, and this rotational force is transmitted to the movable blade 45. That is, the movable blade 45 moves in the left-right direction while rotating with respect to the fixed blade 15.

The frame 10 is provided with a first sensor 31 and a second sensor 32 that detect the position of the movable blade 45. The first sensor 31 detects that the movable blade 45 is at a first position on the side of the first pulley 21. The first position is a position in which the movable blade 45 comes into contact with the left end of the fixed blade 15 near the first pulley 21. The second sensor 32 detects that the movable blade 45 is at a second position on the side of the second pulley 22. The second position is a position in which the movable blade 45 comes into contact with the right end of the fixed blade 15 near the second pulley 22. A snap-action switch that turns on and off through physical contact, a non-contact proximity sensor using light or magnetism, or the like can be used as the first and second sensors 31 and 32.

The first sensor 31 is disposed between the guide portion 11 and the pair of pulleys 20 at a position overlapping with the holder 40 in the up-down direction. In the left-right direction, the first sensor 31 is positioned on the second pulley 22 side of the first pulley 21. Further, in the left-right direction, the first sensor 31 is positioned further to the outside than the end portion on the first position side of the guide portion 11. The first sensor 31 of the present embodiment is provided between the first pulley 21 and the end portion of the guide portion 11 on the first pulley 21 side in the left-right direction, and between the subframe 13 and the rack 12 in the up-down direction.

The second sensor 32 is disposed between the guide portion 11 and the pair of pulleys 20 at a position overlapping with the holder 40 in the up-down direction. In the left-right direction, the second sensor 32 is positioned on the first pulley 21 side of the second pulley 22. Further, in the left-right direction, the second sensor 32 is positioned further to the outside than the end portion on the second position side of the guide portion 11. The second sensor 32 of the present embodiment is provided between the second pulley 22 and the end portion of the guide portion 11 on the second pulley 22 side in the left-right direction, and between the subframe 13 and the rack 12 in the up-down direction.

Here, when the first sensor 31 and the second sensor 32 are the non-contact sensors, it is preferable that detection portions of the first sensor 31 and the second sensor 32 be disposed higher than a first arm 41 and a second arm 42, which will be described later. In this case, it is possible to reduce the accumulation of paper dust or the like in the detection portion, and detection defects can be prevented.

As illustrated in FIG. 2 and FIG. 3, the holder 40 includes a cover 40*a* and a holder main body 40*b*. A groove that slidably engages with the guide portion 11 is provided in the upper end of the holder main body 40*b*. A belt engaging portion 43 that engages with the endless belt 25 is provided on the lower end of the holder main body 40*b*. The holder 40 is configured to be guided by the guide portion 11, and to be movable in the left-right direction together with the endless belt 25.

The holder 40 includes the first arm 41 protruding from the holder main body 40*b* toward the first position, and the second arm 42 protruding from the holder main body 40*b* toward the second position. The first arm 41 and the second arm 42 extend from substantially the center in the up-down direction of the holder 40, along the upper end of the subframe 13.

When the holder 40 is at the first position, the first arm 41 is positioned at a position facing the detection portion of the first sensor 31. Specifically, by driving the motor that rotates the first pulley 21, the holder 40 moves from the second position toward the first position together with the endless belt 25. When the holder 40 reaches the first position, the first sensor 31 senses that the first arm 41 is in contact with or in proximity to the detector. As a result, the driving of the motor that rotates the first pulley 21 is stopped, and the holder 40 is positioned at the first position.

When the holder 40 is at the second position, the second arm 42 is positioned at a position facing the detection portion of the second sensor 32. Specifically, by driving the motor that rotates the first pulley 21, the holder 40 moves from the first position toward the second position together with the endless belt 25. When the holder 40 reaches the second position, the second sensor 32 senses that the second arm 42 is in contact with or in proximity to the detector. As a result, the driving of the motor that rotates the first pulley 21 is stopped, and the holder 40 is positioned at the second position.

A fixed shaft 51 extending along the Y axis is provided between the cover 40*a* and the holder main body 40*b*. A first gear 56, the movable blade 45, and a flange 53 are mounted on the fixed shaft 51 in that order from the holder main body 40*b* toward the cover 40*a*. Further, a bushing 52 for smoothly rotating the first gear 56, the movable blade 45, and the flange 53 with respect to the fixed shaft 51 is inserted between the fixed shaft 51 and the first gear 56, the movable blade 45, and the flange 53.

A portion of the movable blade 45 is exposed below the holder 40, and the rear surface of the movable blade 45 and the surface of the fixed blade 15 are configured to be able to come into contact. The flange 53 presses the movable blade 45 toward the first gear 56, using a spring member 54. That is, the movable blade 45 is caused to come into contact with the fixed blade 15 at a predetermined pressing force. Further, a second gear 55 that is engaged with the rack 12 and the first gear 56 is provided between the holder main body 40*b* and the first gear 56. Because the movable blade 45 is coupled so as to be able to rotate together with the first gear 56, the movable blade 45 rotates in accordance with movement of the holder 40 in the left-right direction.

The cutter device 1 moves in the left-right direction while the movable blade 45 rotates in a state of being pressed against the fixed blade 15, thus cutting the recording medium S that is transported from the paper feed port 16 and that protrudes to the front from the fixed blade 15. Note that the driving of the cutter device 1 is controlled by a control unit provided for an apparatus, such as a printing apparatus, into which the cutter device 1 is incorporated.

According to the present embodiment, the following effects can be obtained.

The cutter device 1 includes the first sensor 31 and the second sensor 32 that detect the position in the left-right direction of the holder 40 holding the movable blade 45. The first sensor 31 and the second sensor 32 are disposed at the positions overlapping with the holder 40 in the up-down direction, thus making it possible to reduce the size of the cutter device 1 in the up-down direction.

The cutter device 1 includes the first pulley 21 and the second pulley 22 spanned by the endless belt 25 that engages with the holder 40 and moves the holder 40 in the left-right direction. Since the first sensor 31 is positioned on the second pulley 22 side of the first pulley 21, and the second sensor 32 is positioned on the first pulley 21 side of the second pulley 22, the size of the cutter device 1 in the left-right direction can be reduced.

The cutter device 1 is provided with the guide portion 11 that guides the holder 40 that moves in the left-right direction. Since the first sensor 31 and the second sensor 32 are disposed between the guide portion 11 and the pair of pulleys 20 in the up-down direction, the size of the cutter device 1 provided with the guide portion 11 in the up-down direction can be reduced.

In the left-right direction, the first sensor 31 is disposed between the first pulley 21 and the end portion of the guide portion 11 on the first pulley 21 side, and the second sensor 32 is disposed between the second pulley 22 and the end portion of the guide portion 11 on the second pulley 22 side, so that the size, in the left-right direction, of the cutter device 1 provided with the guide portion 11 can be reduced.

2. Second Embodiment

Figure 4:
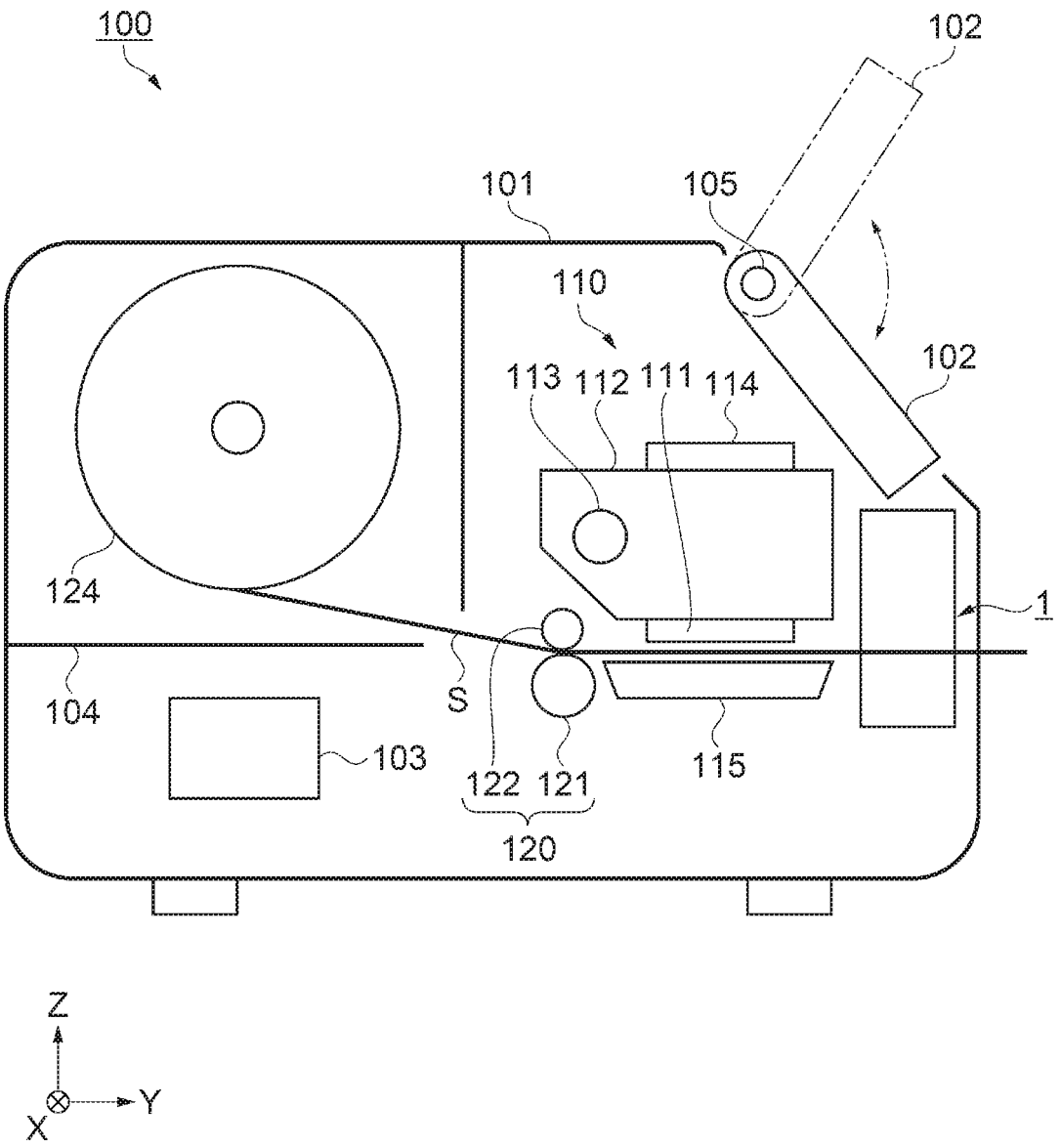
FIG. 4 is a cross-sectional view illustrating an internal configuration of a printing apparatus according to a second embodiment.

FIG. 4 is a cross-sectional view illustrating an internal configuration of a printing apparatus according to a second embodiment. The configuration of a printing apparatus 100 provided with the cutter device 1 described in the first embodiment will be described.

The printing apparatus 100 is configured by a housing 101 and a panel 102 capable of opening and closing part of the interior of the housing 101 with respect to the outside. The panel 102 is coupled to the housing 101 via a shaft 105 supported by the housing 101 and is configured to open and close toward the front with respect to the housing 101, by pivoting about the shaft 105. The panel 102 is a liquid crystal screen provided with a touch panel, and is configured to display visual information to a user and receive input operations from the user, for example. Note that a specific mechanism for opening and closing the panel 102 with respect to the housing 101 is not particularly limited. The cutter device 1 is built into the front of the interior of the printing apparatus 100.

The printing apparatus 100 includes a control unit 103, a housing unit 104, a printing unit 110, a transport unit 120, and the like.

The control unit 103 is provided with a central processing unit (CPU) that is a processor, a memory, and the like. The control unit 103 generates recording data for recording on the recording medium S, as a result of the processor executing arithmetic processing in accordance with a program stored in the memory. As a result of the control unit 103 controlling each unit of the printing apparatus 100 on the basis of the recording data, an image or the like is recorded on the recording medium S. The processor is not limited to the single CPU, and may be configured to perform processing using a plurality of the CPUs, or a hardware circuit such as an application specific integrated circuit (ASIC), or may have a configuration in which the CPU and the hardware circuit perform the processing in concert with each other.

The housing unit 104 is provided to the rear inside the housing 101, and forms a space for housing the recording medium S. A roll paper main body 124, around which the long recording medium S is wound in a roll shape, is housed in the housing unit 104. The printing apparatus 100 is configured to allow the roll paper main body 124 to be fitted into the housing unit 104 from a lid (not illustrated), by opening the lid. Recording is possible on the recording medium S using a recording agent, such as ink, toner, or the like, and the recording medium S may be any material that can be cut by the cutter device 1.

The printing unit 110 is provided with a recording head 111, a carriage 112, a platen 115, and the like.

The platen 115 supports the recording medium S that is wound out from the roll paper main body 124 and transported to a position facing the recording head 111 along the Y axis, which is a transport direction. The recording head 111 is disposed above the platen 115.

The recording head 111 includes a plurality of nozzles capable of discharging ink, and performs recording using an ink-jet method. The recording head 111 receives a supply of the ink from an ink cartridge 114. The recording head 111 and the ink cartridge 114 are mounted on the carriage 112. The carriage 112 is supported by a guide rail 113 disposed along the X axis, and is configured to be reciprocally movable in both directions along the X axis, which is a main scanning direction. The recording head 111 performs the recording on the recording medium S by discharging the ink from the nozzles as the carriage 112 moves. The printing apparatus 100 is configured to allow replacement of the ink cartridge 114 and maintenance of the printing unit 110 by opening the panel 102. Note that, in the present embodiment, as the recording head 11, a serial head type is exemplified in which a head mounted on the carriage 112 discharges the ink while reciprocally moving in the main scanning direction, but may be a line head type in which recording heads are arranged and fixed extending in the left-right direction along the X axis, that is, in a width direction of the recording medium S.

The transport unit 120 is provided with rollers 121 and 122.

The rollers 121 and 122 are a pair of rollers disposed upstream of the platen 115 in the transport direction. The rollers 121 and 122 transport the recording medium S by rotating while sandwiching the recording medium S therebetween. The roller 121 is a drive roller that rotates as a result of being powered by a motor. The roller 122 is a driven roller that rotates in accordance with the rotation of the drive roller. Note that a configuration may be adopted in which a plurality of roller pairs are provided for transporting the recording medium S.

The cutter device 1 that cuts the recording medium S that is printed by the printing unit 110 and transported in the transport direction is provided downstream of the platen 115 in the transport direction.

Note that the printing apparatus 100 may be an apparatus configured to perform recording using a method that is not the ink-jet method. For example, in place of the recording head 111, the printing apparatus 100 may be provided with a printer engine that performs recording by depositing toner onto the recording medium S using an electrophotographic method. Further, the printing apparatus 100 may be a thermal printer.

According to the present embodiment, the following effects can be obtained.

Since the printing apparatus 100 is provided with the cutter device 1 having the small size, the size of the housing 101 of the printing apparatus 100 can be reduced.

Contents derived from the embodiments will be described below.

A cutter device includes a pair of pulleys including a first pulley and a second pulley, an endless belt spanning the pair of pulleys, a movable blade, a holder configured to hold the movable blade, engage with the endless belt, and move in a movement direction in accordance with a movement of the endless belt, a first sensor configured to detect that a position of the movable blade is at a first position on the first pulley side, and a second sensor configured to detect that the position of the movable blade is at a second position on the second pulley side. The first sensor and the second sensor are disposed at positions overlapping with the holder in an up-down direction intersecting the movement direction. The holder includes a first arm protruding from a holder main body toward the first position and a second arm protruding from the holder main body toward the second position. The first arm is positioned at a position facing a detection portion of the first sensor when the holder is positioned at the first position, and the second arm is positioned at a position facing a detection portion of the second sensor when the holder is positioned at the second position.

According to this configuration, the first sensor and the second sensor are disposed at the positions overlapping, in the up-down direction, with the holder that holds the movable blade. Thus, a size of the cutter device in the up-down direction can be reduced, compared to a configuration in which the first and second sensors are provided above the holder.

In the cutter device described above, the first sensor is preferably positioned on the second pulley side of the first pulley in the movement direction, and the second sensor is preferably positioned on the first pulley side of the second pulley in the movement direction.

According to this configuration, the first sensor and the second sensor are disposed further to the inside than the first and second pulleys, and thus, the size of the cutter device in the left-right direction can be reduced.

The cutter device described above preferably includes a guide portion configured to engage with the holder and guide movement of the holder when the holder moves in the movement direction, and the first sensor and the second sensor are preferably positioned between the guide portion and the pair of pulleys in the up-down direction.

According to this configuration, the first sensor and the second sensor are disposed between the guide portion and the pair of pulleys in the up-down direction, and thus, the size of the cutter device in the up-down direction can be reduced.

In the cutter device described above, in the movement direction, the first sensor is preferably positioned further to the outside than an end portion of the guide portion on the first position side, and the second sensor is preferably positioned further to the outside than an end portion of the guide portion on the second position side.

According to this configuration, the first sensor and the second sensor are disposed alongside the guide portion in the left-right direction, and thus, the size of the cutter device in the up-down direction can be reduced.

A printing apparatus includes the cutter device described above.

According to this configuration, since the printing apparatus is provided with the small cutter device, it is possible to reduce the size of the printing apparatus.

What is claimed is:

1. A cutter device comprising:

a pair of pulleys including a first pulley and a second pulley;

an endless belt spanning the pair of pulleys;

a movable blade;

a holder configured to hold the movable blade, engage with the endless belt, and move in a movement direction in accordance with a movement of the endless belt;

a first sensor configured to detect that a position of the movable blade is at a first position on the first pulley side; and a second sensor configured to detect that the position of the movable blade is at a second position on the second pulley side, wherein the first sensor and the second sensor are disposed at positions overlapping with the holder in an up-down direction intersecting the movement direction, the holder includes a first arm protruding from a holder main body toward the first position and a second arm protruding from the holder main body toward the second position, the first arm is positioned at a position facing a detection portion of the first sensor when the holder is positioned at the first position, and the second arm is positioned at a position facing a detection portion of the second sensor when the holder is positioned at the second position.

2. The cutter device according to claim 1, wherein the first sensor is positioned on the second pulley side of the first pulley in the movement direction, and the second sensor is positioned on the first pulley side of the second pulley in the movement direction.

3. The cutter device according to claim 1, comprising a guide portion configured to engage with the holder and guide movement of the holder when the holder moves in the movement direction, wherein the first sensor and the second sensor are positioned between the guide portion and the pair of pulleys in the up-down direction.

4. The cutter device according to claim 3, wherein in the movement direction, the first sensor is positioned further to the outside than an end portion of the guide portion on the first position side, and the second sensor is positioned further to the outside than an end portion of the guide portion on the second position side.

5. A printing apparatus comprising the cutter device according to claim 1.

* * * * *